US007479044B1

(12) United States Patent
MacCrindle et al.

(10) Patent No.: US 7,479,044 B1
(45) Date of Patent: Jan. 20, 2009

(54) LAMP SOCKET

(75) Inventors: Donald J. MacCrindle, Village of Lakewood, IL (US); Scott Huerter, Sarnia (CA)

(73) Assignee: St. Clair Technologies, Inc., Wallaceburg, Ontario (CA)

( * ) Notice: Subject to any disclaimer, the term of this patent is extended or adjusted under 35 U.S.C. 154(b) by 0 days.

(21) Appl. No.: 11/999,793

(22) Filed: Dec. 7, 2007

(51) Int. Cl.
*H01R 24/00* (2006.01)

(52) U.S. Cl. ..... 439/699.2; 439/942

(58) Field of Classification Search ..... 439/699, 439/699.2, 700, 701, 706, 707, 711, 721
See application file for complete search history.

(56) References Cited

U.S. PATENT DOCUMENTS

| | | | | |
|---|---|---|---|---|
| 3,114,508 | A | 12/1963 | Trautner et al. | |
| 3,544,950 | A | 12/1970 | Lopez et al. | |
| 3,829,729 | A | 8/1974 | Westlund, Jr. et al. | |
| 3,857,056 | A | 12/1974 | Miller et al. | |
| 3,936,131 | A | 2/1976 | Durand | |
| 3,947,083 | A | 3/1976 | Ahmed et al. | |
| 3,950,061 | A | 4/1976 | Kausen | |
| 3,979,627 | A | 9/1976 | Leadvaro et al. | |
| 4,028,577 | A | 6/1977 | Gates et al. | |
| 4,052,638 | A | 10/1977 | Love et al. | |
| 4,181,390 | A | 1/1980 | Aizawa | |
| 4,367,573 | A | 1/1983 | Baba et al. | |
| 4,390,936 | A | 6/1983 | Slater, Jr. et al. | |
| 4,471,414 | A | 9/1984 | Savage, Jr. | |
| 4,573,754 | A * | 3/1986 | Hill | 439/280 |
| 4,588,248 | A | 5/1986 | Moore | |
| 4,647,132 | A | 3/1987 | Mikola | |
| 4,804,343 | A * | 2/1989 | Reedy | 439/854 |
| 4,883,434 | A | 11/1989 | Toyoshima | |
| 4,957,455 | A | 9/1990 | Horiuchi et al. | |
| 5,008,588 | A | 4/1991 | Nakahara | |
| 5,032,090 | A | 7/1991 | Roy | |
| 5,046,970 | A | 9/1991 | Brodner et al. | |
| 5,078,625 | A | 1/1992 | Anzai | |
| 5,096,427 | A | 3/1992 | Sadigh-Behzadi | |
| 5,120,233 | A * | 6/1992 | Mikola | 439/356 |

(Continued)

FOREIGN PATENT DOCUMENTS

| | | |
|---|---|---|
| FR | 2739229 | 9/1995 |

(Continued)

OTHER PUBLICATIONS

AMD; Faston Terminals (Insulated and Uninsulated); Catalog 82004; pp. 1-3, 79-82, 89-91.

(Continued)

*Primary Examiner*—Neil Abrams
*Assistant Examiner*—Harshad C Patel
(74) *Attorney, Agent, or Firm*—Greer, Burns & Crain, Ltd.

(57) ABSTRACT

A lamp socket includes a housing having a lamp receiving portion and a lead receiving portion, an insert coupled to the housing, the insert being separately formed from the housing and configured for separating the lamp receiving portion from the lead receiving portion, and a plurality of terminals carried by the insert, each terminal having at least one blade in the lamp receiving portion and a lead end in the lead receiving portion.

14 Claims, 5 Drawing Sheets

U.S. PATENT DOCUMENTS

| | | | | |
|---|---|---|---|---|
| 5,141,449 | A | 8/1992 | Tieszen | |
| 5,156,560 | A | 10/1992 | Thomas | |
| 5,236,098 | A | 8/1993 | Sadigh-Behzadi | |
| 5,286,223 | A | 2/1994 | Ogawa | |
| D362,656 | S | 9/1995 | Roos et al. | |
| 5,547,402 | A | 8/1996 | Ogawa | |
| 5,634,823 | A | 6/1997 | Furuta et al. | |
| 5,709,571 | A * | 1/1998 | Briski et al. | 439/699.2 |
| 5,795,170 | A | 8/1998 | Okabe | |
| 5,800,183 | A * | 9/1998 | Paul et al. | 439/56 |
| 5,823,806 | A | 10/1998 | Nagase et al. | |
| 5,846,100 | A | 12/1998 | Ogawa | |
| 5,876,249 | A | 3/1999 | Kim | |
| 6,039,579 | A | 3/2000 | Paul et al. | |
| 6,056,417 | A | 5/2000 | Cheng | |
| 6,083,050 | A | 7/2000 | Hsu | |
| 6,083,054 | A | 7/2000 | Suzuki et al. | |
| 6,162,084 | A | 12/2000 | Chen et al. | |
| 6,224,428 | B1 | 5/2001 | Chen et al. | |
| 6,232,707 | B1 | 5/2001 | Ranish et al. | |
| 6,464,539 | B2 | 10/2002 | Yoshida et al. | |
| 6,467,942 | B2 * | 10/2002 | Alloway et al. | 362/549 |
| 6,692,308 | B2 * | 2/2004 | Henrici et al. | 439/699.2 |
| 7,014,510 | B2 | 3/2006 | Powers et al. | |
| 7,021,815 | B1 * | 4/2006 | Yang | 362/655 |
| 7,052,301 | B2 * | 5/2006 | Garcia et al. | 439/336 |
| 7,063,575 | B2 | 6/2006 | Powers et al. | |
| 7,153,171 | B1 * | 12/2006 | Goto | 439/699.2 |
| 7,192,315 | B2 | 3/2007 | Powers et al. | |
| 7,204,711 | B2 * | 4/2007 | Garcia et al. | 439/336 |
| 2001/0013748 | A1 | 8/2001 | Ishihara | |
| 2003/0119376 | A1 * | 6/2003 | Henrici et al. | 439/699.2 |
| 2004/0132336 | A1 | 7/2004 | Powers et al. | |

FOREIGN PATENT DOCUMENTS

| | | |
|---|---|---|
| FR | 2740616 | 10/1995 |
| JP | 6451286 | 3/1989 |
| JP | 2312175 | 12/1990 |
| JP | 4126688 | 11/1992 |
| JP | 511381 | 2/1993 |
| JP | 6267319 | 9/1994 |
| JP | 7272809 | 10/1995 |
| JP | 9309116 | 5/1996 |
| JP | 2005 11818 | 1/2005 |

OTHER PUBLICATIONS

AMP; Interconnection Systems; Selection Guide 82750; Revised Jul. 1995.

* cited by examiner

LAMP SOCKET

BACKGROUND OF THE INVENTION

The present invention relates to lamp sockets, and more particularly, to a wedge base sealed lamp socket for automobile lighting. Such wedge base sealed lamp sockets are known in the art and are typically configured for mechanically securing a lamp in place.

Conventional lamp sockets generally include a socket body and a plurality of terminals located within the body for providing an electrical connection to respective lamp leads. One end of each terminal is located in a lamp receiving end of the body for securing the lamp, while the other end of the terminal is located in a back portion of the body and is connected to a wire lead for providing power to the terminal and the lamp. The terminals are typically secured in the socket body by being pushed through corresponding openings defined in a partition of the socket body. However, improper placement in the openings during lamp socket construction can damage the terminals or result in faulty electrical connections between the wire leads and lamp leads.

To more securely hold the lamp within the socket body, lamp sockets have been developed which include spring clips or other stabilizing devices in addition to the terminals to restrain movement of the lamp within the body. However, it can be difficult to properly position the spring clip within the socket body without interfering with the terminals.

Accordingly, there is a need for an improved lamp socket for a wedge base lamp.

SUMMARY OF THE INVENTION

The present lamp socket addresses the above-identified concerns by providing a lamp socket that ensures proper placement of the terminals within the socket body and provides a reliable electrical connection between the wire leads and lamp leads. Also, the present lamp socket includes a spring or lamp base clip that securely retains the lamp within the socket and does not interfere with the terminals.

More particularly, a lamp socket includes a housing having a lamp receiving portion and a lead receiving portion, an insert separately formed from the housing and configured for separating the lamp receiving portion from the lead receiving portion, and a plurality of terminals configured for being carried by the insert.

DETAILED DESCRIPTION

Figure 1:
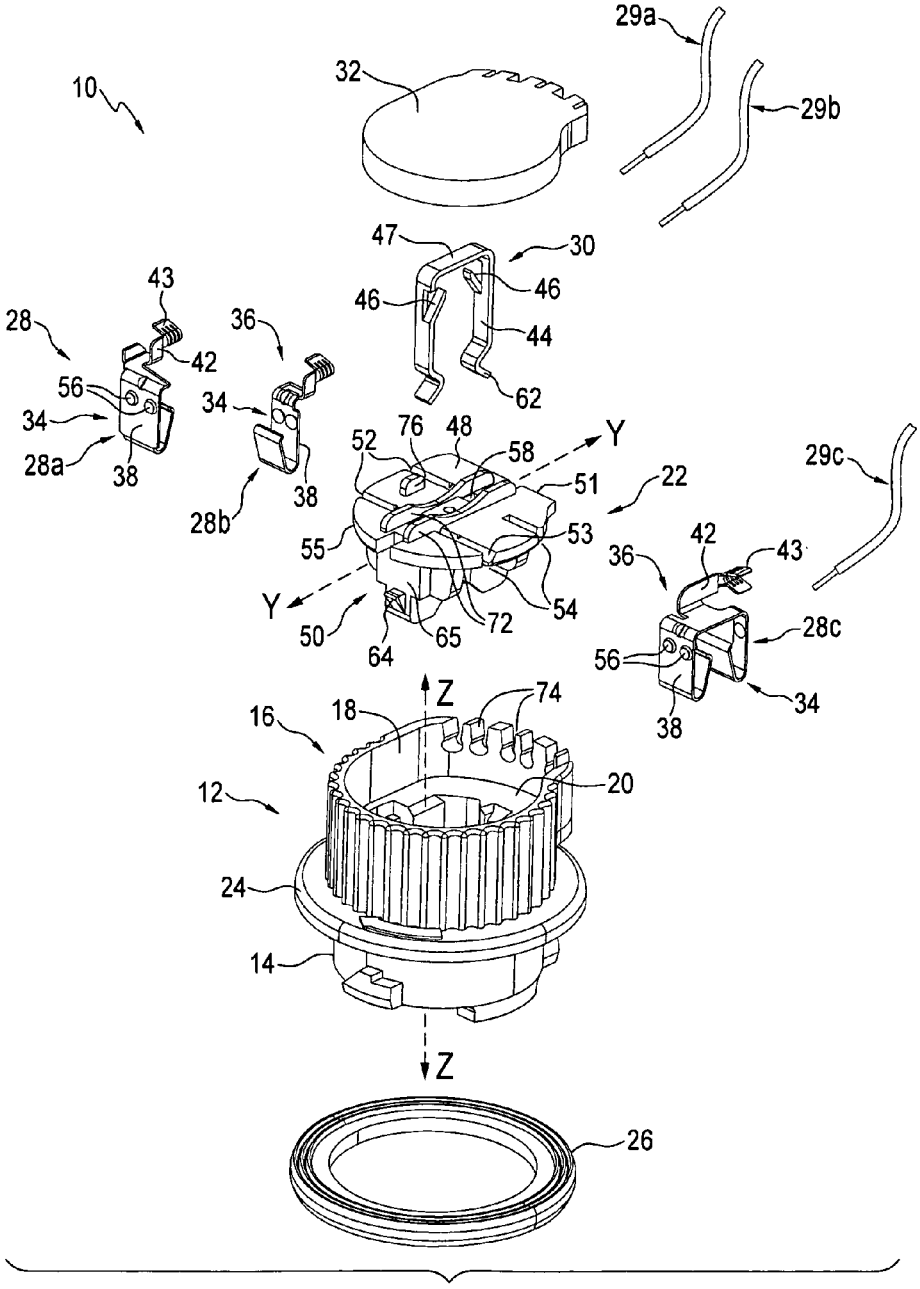
FIG. 1 is an exploded perspective view of the present lamp socket.

Referring now to FIGS. 1-5, a lamp socket for an automobile lamp is generally designated 10 and includes a housing 12 having a front or lamp receiving portion 14 and a back or lead receiving portion 16. The housing 12 defines a generally cylindrical chamber having a longitudinal or z-axis. The back portion 16 is aligned with and axially spaced from the lamp receiving portion 14. The back portion 16 has at least one sidewall 18 integrally formed with the socket housing 12 and defining a seat 20 for receiving an insert 22. Preferably, the seat 20 extends inwardly from the sidewall 18 towards a center of the housing 12, and is arranged substantially perpendicular to a z-axis of the housing.

As seen in FIG. 1, the insert 22 is separately formed from the housing 12 and upon installation in the housing, is configured for separating the lamp receiving portion 14 from the back portion 16. A lip 24 radially extends from and surrounds the housing 12 and is configured for receiving an o-ring 26 or similar sealing member, as known in the art. Both the insert 22 and housing 12 are preferably molded from a non-conductive material such as plastic, although other materials with similar properties may be appropriate.

A plurality of terminals 28 and a lamp base clip 30 are also provided and are configured for being carried by the insert 22, which will be described in further detail below. Specifically, a major terminal 28*a*, a minor terminal 28*b* and a ground terminal 28*c* are provided, each of the terminals being fabricated from a conductive material, such as brass. Potting resin 31 or the like is configured for being received in the back portion 16 for encapsulating a portion of the terminals 28*a-c* and their corresponding wire leads 29*a-c*. In addition to or in lieu of the potting resin 31, a cap 32 or other similar closure formation can be provided for protecting the terminals 28 and wire leads 29.

Figure 2:
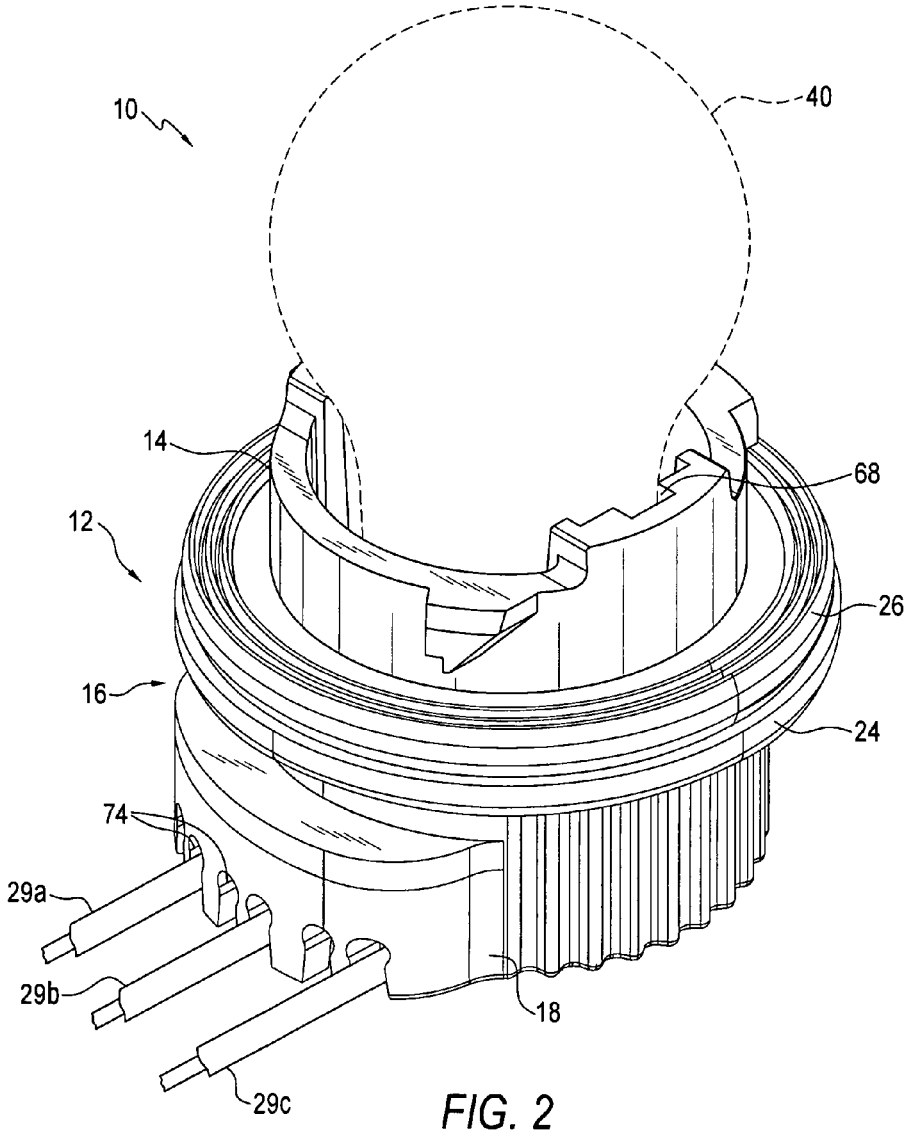
FIG. 2 is a perspective view of the present lamp socket having a lamp assembled therein.

Preferably, the terminals 28 are right angle terminals, as known in the art, and each includes a lamp receiving end 34 arranged substantially perpendicular to a lead receiving end 36. Each of the terminals 28 also includes at least one blade 38 at the lamp receiving end 34 for engaging a lamp 40 (FIG. 2). A crimp cradle 42 extends from the lead receiving end 36 and includes fingers 43 constructed and arranged for being mechanically crimped for securing the wire leads 29 and providing an electrical and mechanical connection to the lamp 40. Although other configurations may be suitable, the crimp cradle 42 is preferably arranged substantially perpendicular to the lead receiving end 36, and the fingers 43 extend substantially horizontally from the crimp cradle such that the fingers are substantially transverse to the z-axis of the housing 12.

As seen in FIG. 1, the lamp base clip 30 includes a pair of prongs 44 for engaging a base portion of the lamp 40. Preferably, the clip 30 is manufactured of stainless steel for strength and durability, although other metals with similar properties are contemplated. To prevent "wobbling" or lateral movement of the lamp 40 within the housing 12, the prongs 44 are preferably laterally aligned with each other. It is contemplated that such lateral alignment provides a more stable connection to the lamp 40 than lamp base clips having laterally offset prongs. Each of the prongs 44 includes a locking tab 46 extending near a base 47 of the clip 30 and configured for engaging a corresponding indentation or slot (not shown) in the insert 22 for securing the clip in the correct orientation, although other structures for properly securing the clip may be appropriate to suit the application.

Figure 5:
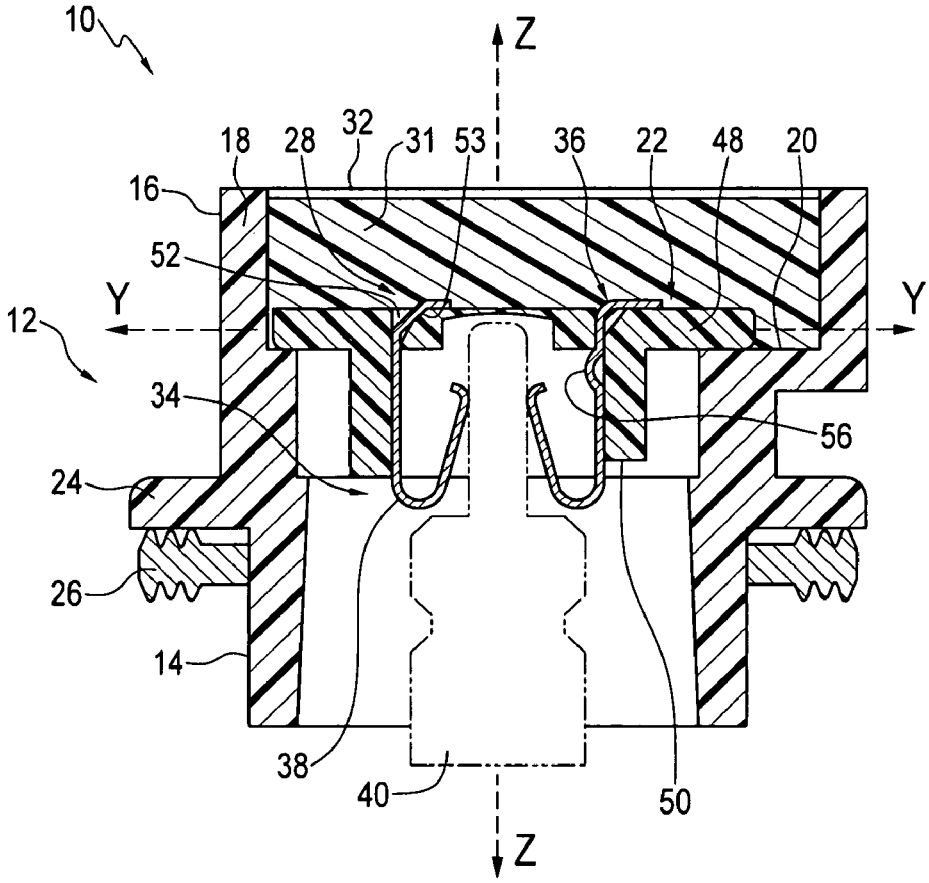
FIG. 5 is a cross-section view of the lamp socket shown in FIG. 3 taken along the line 5-5 and in the direction indicated with potting resin.

The insert 22 includes a plate 48 arranged within the housing 12 substantially perpendicular to the z-axis of the housing, and a pair of legs 50 depending from and substantially perpendicular to the plate. Accordingly, as seen in FIGS. 1 and 5, when the insert 22 is placed within the housing 12, the plate 48 defines a partition between the lamp receiving portion 14 and the lead receiving portion 16. The plate 48 is substantially circular with a substantially flat end 51, to correspond with the shape of the back portion 16 and corresponding sidewall 18. It is contemplated that by providing the plate 48 with such an asymmetrical shape, improper placement of the insert 22 within the housing is prevented. Further, by forming the insert 22 complementarily to the back portion 16, a tight fit is provided, preventing potting resin 31 from entering the lamp receiving portion 14, which can damage the electrical connection between the lamp 40 and the terminals 28.

To ensure proper placement of the terminals 28 within the housing 12, the plate 48 includes a plurality of and preferably a first slot 52*a* for receiving the major terminal 28*a*, a second slot 52*b* for receiving the minor terminal 28*b*, and at least one and preferably a pair of slots 54 for receiving the ground terminal 28*c*, although other configurations may be appropriate. Preferably, each of the slots 52*a*, 52*b* and 54 are arranged substantially transverse to a y-axis of the plate 48. The first and second slots 52*a*, 52*b* are preferably (but not necessarily) aligned with a corresponding slot 54, and extend inwardly from an external edge 55 of the plate 48. Preferably, each of the slots 52*a*, 52*b* and 54 includes at least one angled or beveled edge 53 for enabling the terminals 28 to easily and snugly slide into their respective slots.

Figure 3:
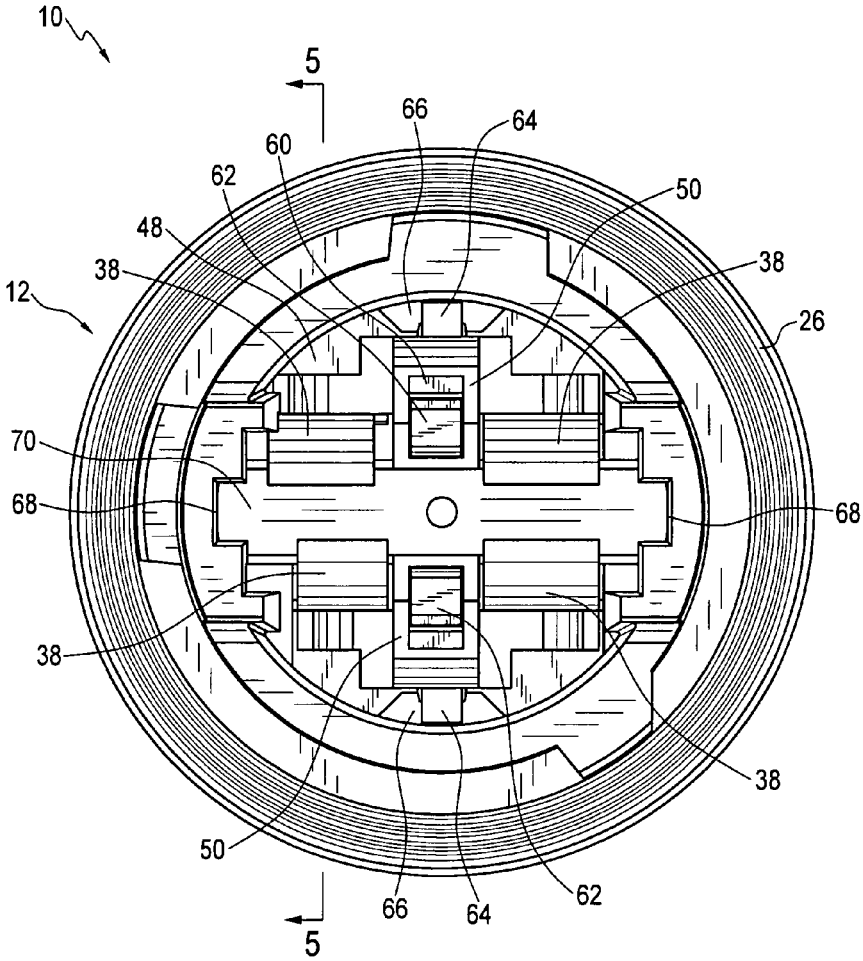
FIG. 3 is a front view of the present lamp socket.
Figure 4:
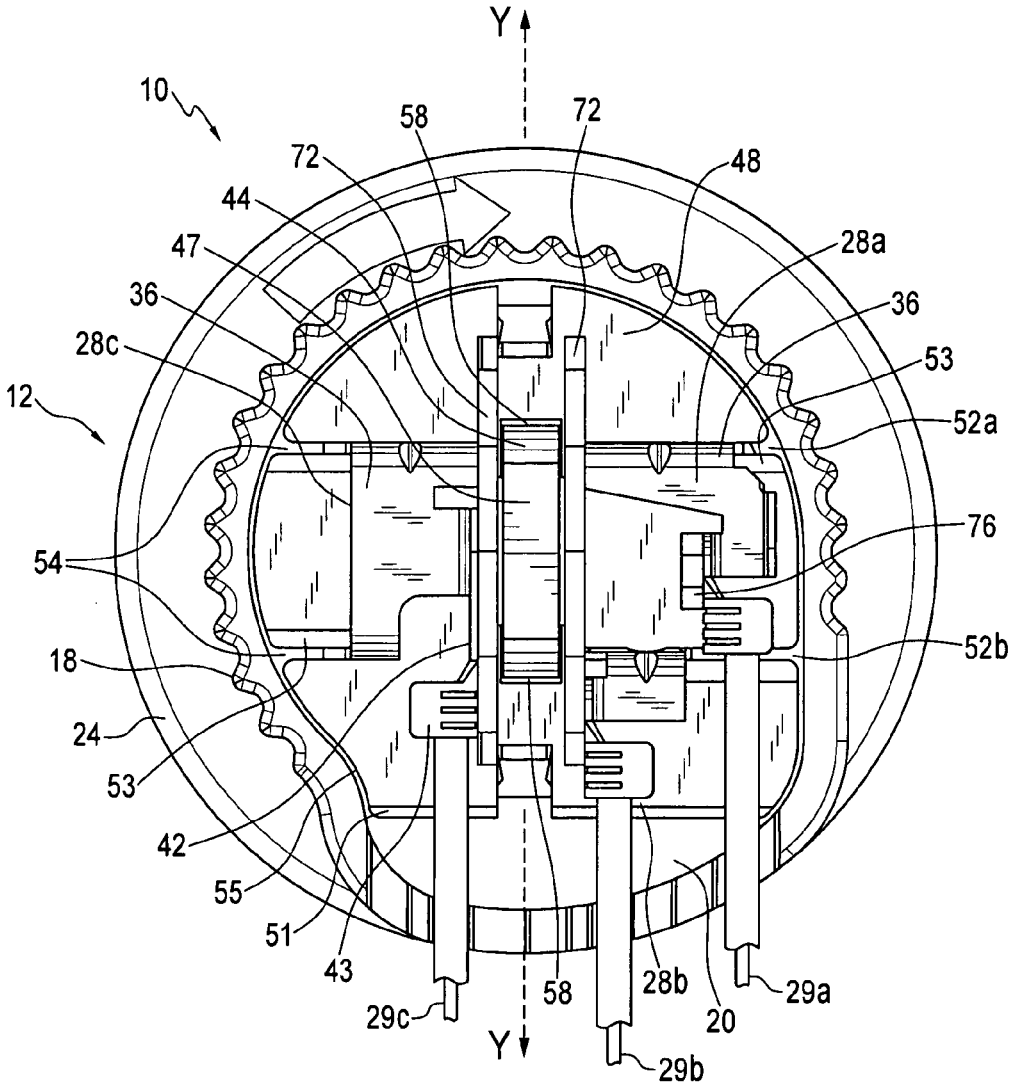
FIG. 4 is a back view of the lamp socket shown in FIG. 3 without potting resin.

As seen in FIGS. 1 and 4, the terminal blades 38 are constructed and arranged for being slidably received in one of the slots 52*a*, 52*b*, 54, such that when installed the lamp receiving end 34 is located in the lamp receiving portion 14 of the housing 12, and the lead receiving end 36 is located in the back portion 16 of the housing, as shown in FIGS. 3 and 4. The slots 52*a*, 52*b* and 54 are wide enough to receive the corresponding terminals 28, but are narrow enough such that potting resin 31 will not seep through the slots and enter the lamp receiving portion 14.

Each of the blades 38 includes at least one detent 56 protruding from either an internal or external side of the blade (FIG. 1). The detents 56 are preferably hemispherical or rounded and are constructed and arranged for guiding the terminals 28*a-c* into their respective slots 52*a*, 52*b*, 54. Specifically, when sliding the terminals 28 into their respective slots 52*a*, 52*b* and 54, the terminals are aligned with the plate 48 such that the slots are arranged between the lead end 36 and the detents 56, and the terminals are slid into the slots until they reach the slot end. When the terminals are so inserted, the detents prevent axial movement of the terminals 28. However, it is appreciated that other similar locking mechanisms may be appropriate, depending on the application.

To secure the clip 30 within the housing 12, the plate 48 further includes a pair of spaced apart openings 58 substantially in the center of the plate and configured for receiving a corresponding one of the prongs 44. The openings 58 are preferably laterally aligned with each other. Further, each of the openings 58 are aligned with an aperture 60 defined in a corresponding one of the legs 50.

To insert the clip 30 into the openings 58, the prongs 44 are aligned with their corresponding openings and the clip is inserted through the openings and apertures 60 until the locking tabs 46 are received in their respective indentations (not shown), and a gripping portion 62 of the prongs extends through a corresponding one of the apertures 60, as seen in FIG. 3. Accordingly, when properly inserted, the clip base 47 is in contact with the plate 48, and the gripping portions 62 are in the lamp receiving portion 14 for gripping the base of lamp 40.

Referring now to FIG. 1, the insert legs 50 each preferably include an alignment and locking tab 64 extending from an outer sidewall 65 of the leg for engaging a corresponding channel 66 defined in the sidewall 18 of the back portion 16. The channels 66 are preferably oppositely located from each other, are arranged adjacent to the seat 20 and extend along the sidewall 18 in a direction substantially parallel to the z-axis of the housing 12 for a predetermined length. To ensure proper placement of the insert 22 within the housing 12 and to prevent movement of the insert relative to the housing, the tabs 64 are aligned with their respective channels 66 and the insert is inserted until the tabs engage and lock into place at the end of the channel in the socket housing 12, and the plate 48 engages the seat 20, permanently locking the insert 22 into the housing (FIG. 5). Accordingly, when properly placed within the housing, the insert 22 is arranged such that the plate 48 is substantially perpendicular to the z-axis of the housing 12, and the legs 50 are substantially parallel to the z-axis. However, it is appreciated that other locking mechanisms for the insert 22 may be appropriate, such as a snap-fit or twist-and-lock fit, for example.

The lamp receiving portion 14 defines at least one and preferably two pairs of tracks 68 oppositely located from each other and configured for receiving a base (not shown) of the lamp 40. Preferably, the tracks 68 extend substantially parallel to the z-axis of the housing 12. The tracks 68 are also arranged such that each track is approximately 90° away from a corresponding one of the channels 66, and vice versa. When the insert 22 is placed within the housing 12, the legs 50 are arranged substantially perpendicular to the tracks 68 such that the legs and the tracks define a lamp base receiving channel 70. The blades 38 extend into the lamp receiving portion 14 and are axially aligned with the legs 50 and clip prongs 44 for further defining the channel 70. It is contemplated that the combination of the tracks 68, blades 38 and prongs 44 grip the lamp base and prevent axial movement and lateral wobbling of the lamp 40 within the socket 10.

Construction of the lamp socket 10 can be completed as follows. An end of each of the wire leads 29*a*-29*c* is crimped onto a corresponding lead end of each terminal 28. As described above, the terminals 28 are inserted into their respective slots 52*a*, 52*b* and 54. To prevent the lamp base clip 30 from interfering with the terminals 28, a pair of guards 72 are preferably provided on either side of the pair of openings 58 such that the guards extend substantially parallel to the y-axis of the insert 22, although other dividers may be suitable. Next, the prongs 44 are aligned with their respective openings 58 and pushed into the openings until the locking tabs 46 have been received in their respective indentations and the prong gripping portions 62 have passed through the leg apertures 60. The insert 22 is then pushed into the socket housing 12 by aligning the alignment tabs 64 with their respective channels 66.

The wire leads 29*a-c* extend through corresponding notches 74 defined in the sidewall 18. To prevent the wire leads 29*a* and 29*c* or lead ends of the terminals 28*a* and 2*bb* from contacting each other, a divider 76 is provided on plate 22. Finally, potting resin 31 or the like is injected into the back portion 16, encapsulating and protecting the electrical connection formed between the wire leads 29 and the terminals 28. The potting resin 31 encapsulates the crimp connection of the leads 29 to the terminals 28, seals the socket 10 and bonds the insert 22, terminals, clip 30 and housing 12 together. To further secure the connection formed between the wire leads 29 and the terminals 28, optional cap 32 can be secured to the back portion 16 of the housing 12. The free ends of the wire leads 29 can be subsequently attached to an appropriate wire harness, as known in the art.

The present lamp socket includes a subassembly comprising separately formed insert 22, terminals 28*a-c*, and clip 30.

The insert 22 is constructed and arranged for dividing the lamp receiving portion 14 from the back portion 16. Such a separately formed insert enables assembly of the terminals 28, lamp base clip 30 and insert prior to being received in the housing 12, which can mitigate damage to the terminals and clip.

While a particular embodiment of the lamp socket has been described herein, it will be appreciated by those skilled in the art that changes and modifications may be made thereto without departing from the invention in its broader aspects and as set forth in the following claims.

The invention claimed is:

1. A lamp socket comprising:

a housing having a lamp receiving portion and a lead receiving portion;

an insert coupled to said housing, said insert including a plate defining a partition between said lamp receiving portion and said lead receiving portion, said plate being arranged within said housing substantially perpendicular to a longitudinal axis of said housing and being separately formed from said housing;

a plurality of terminals carried by said insert, each said terminal having at least one blade in said lamp receiving portion and a lead end in said lead receiving portion; and a plurality of slots, and wherein said plurality of slots comprises a first slot for receiving a major terminal, a second slot for receiving a minor terminal and a pair of slots for receiving a ground terminal, each of said slots being in the plane of a plate 48 and extending in a direction substantially perpendicular to the longitudinal axis of said housing.

2. The lamp socket of claim 1 further including a lamp base clip carried by said insert.

3. The lamp socket of claim 1 wherein each of said terminals includes a lamp receiving end and a lead receiving end, each said terminal being received in at least a respective one of said slots intermediate its ends.

4. The lamp socket of claim 2, wherein said insert, said terminals and said lamp base clip comprise a subassembly within said housing.

5. The lamp socket of claim 2 wherein said insert includes a plate arranged substantially perpendicular to a longitudinal axis of said housing, said plate having a pair of spaced apart openings for receiving said lamp base clip.

6. The lamp socket of claim 1 wherein said lead receiving portion of said housing is sealed with potting resin, said potting resin encapsulating the lead receiving ends of said terminals.

7. A lamp socket comprising:

a housing having a lamp receiving portion and a lead receiving portion;

an insert mounted within said housing and configured for separating said lamp receiving portion from said lead receiving portion, said insert including a plate having a plurality of slots, said plate defining a partition between said lamp receiving portion and said lead receiving portion;

a plurality of terminals configured for being respectively received in said slots and carried by said insert;

a lamp base clip carried by said insert;

potting material in said lead receiving portion of said housing; and said plurality of slots comprises a first slot for receiving a major terminal, a second slot for receiving a minor terminal and a pair of slots for receiving a ground terminal, each of said slots being in the plane of a plate 48 and extending in a direction substantially perpendicular to the longitudinal axis of said housing.

8. The lamp socket of claim 7 wherein each of said terminals includes a lamp receiving end and a lead receiving end, each said terminal received in at least a respective one of said slots intermediate its ends.

9. The lamp socket of claim 7 wherein said plate further includes a pair of spaced apart openings for receiving said lamp base clip.

10. The lamp socket of claim 9 wherein said lamp base clip includes a pair of laterally aligned prongs each arranged for engaging a respective opening defined in said insert.

11. The lamp socket of claim 7, wherein said insert, said terminals and said lamp base clip comprise a subassembly within said housing.

12. The lamp socket of claim 7 wherein each of said terminals has a lamp receiving end and a lead receiving end, said lead receiving end located in said lead receiving portion of said housing and a lamp receiving end being received in lamp receiving portion of said housing, said lead receiving end being at an angle to said lamp receiving end.

13. A lamp socket including:

a housing having an axial chamber defining a lamp receiving portion and a lead receiving portion;

a subassembly being separately formed from said housing and axially mounted in said housing, said subassembly comprising an insert mounted in said axial chamber and configured for separating said lamp receiving portion from said lead receiving portion, said insert including a plate having a pair of spaced apart openings and being arranged substantially perpendicular to a longitudinal axis of said chamber of said housing, said plate including a plurality of slots, each of said slots being substantially parallel to each other and extending in a direction substantially perpendicular to said longitudinal axis, a plurality of terminals carried by said insert, each of said terminals having at least one blade in said lamp receiving portion and a lead in said lead receiving portion, said terminals including a major terminal, a minor terminal and a ground terminal, a plurality of wire leads connected to each of said terminals, respectively, and a lamp base clip having a pair of laterally aligned prongs, said prongs being respectively received in said openings; and potting material in said lead receiving portion of said housing encapsulating the connections of said wire leads to said terminals and sealing said terminals within said housing, said slots including a first slot for receiving said major terminal, a second slot for receiving said minor terminal, and a pair of slots for receiving said ground terminal.

14. The lamp socket of claim 13 further comprising a plurality of notches in a side wall of the lead receiving end of said housing for receiving said wire leads.

* * * * *

UNITED STATES PATENT AND TRADEMARK OFFICE

CERTIFICATE OF CORRECTION

PATENT NO. : 7,479,044 B1
APPLICATION NO. : 11/999793
DATED : January 20, 2009
INVENTOR(S) : MacCrindle et al.

It is certified that error appears in the above-identified patent and that said Letters Patent is hereby corrected as shown below:

In claim 1 (column 5, line 29), delete “48”.

In claim 7 (column 6, line 4), delete “48”.

Signed and Sealed this

Twenty-sixth Day of May, 2009

JOHN DOLL
*Acting Director of the United States Patent and Trademark Office*